US006651267B1

(12) United States Patent
Utz

(10) Patent No.: US 6,651,267 B1
(45) Date of Patent: Nov. 25, 2003

(54) TOILET DEVICE, ESPECIALLY FOR BEDRIDDEN PERSONS

(76) Inventor: Helmut Utz, Kornstr. 30. D-86370, Ebenweiler (DE)

( * ) Notice: Subject to any disclaimer, the term of this patent is extended or adjusted under 35 U.S.C. 154(b) by 30 days.

(21) Appl. No.: 10/148,422

(22) PCT Filed: Sep. 29, 2000

(86) PCT No.: PCT/EP00/09560

§ 371 (c)(1),
(2), (4) Date: May 23, 2002

(87) PCT Pub. No.: WO01/37775

PCT Pub. Date: May 31, 2001

(30) Foreign Application Priority Data

Nov. 25, 1999 (DE) ..... 199 56 722

(51) Int. Cl.[7] ..... A47K 11/02

(52) U.S. Cl. ..... 4/449; 4/443; 4/444; 4/452; 4/457; 604/355; 604/393

(58) Field of Search ..... 4/443–449, 450, 4/452, 454, 456, 457, 111.6, 144.3; 604/332, 345, 347, 355, 393

(56) References Cited

U.S. PATENT DOCUMENTS

| | | | | |
|---|---|---|---|---|
| 1,623,602 A | | 4/1927 | Dudley | |
| 3,729,749 A | * | 5/1973 | Rosecrans | 4/452 |
| 4,791,686 A | | 12/1988 | Taniguchi et al. | |
| 5,669,084 A | | 9/1997 | Sakimura | |
| 5,681,297 A | | 10/1997 | Hashimoto et al. | |
| 5,687,429 A | | 11/1997 | Rahlff | |

FOREIGN PATENT DOCUMENTS

| | | |
|---|---|---|
| DE | 2200033 | 7/1973 |
| DE | 3331390 | 3/1985 |
| DE | G 91 11 153.6 | 1/1992 |
| DE | 4309761 | 8/1994 |
| DE | 43 33 530 | 4/1995 |
| DE | 29612166 | 10/1996 |
| DE | 296 20 335 | 4/1997 |
| EP | 0494488 | 7/1992 |
| EP | 0689790 | 1/1996 |
| FR | 932497 | 3/1948 |
| FR | 2653652 | 5/1991 |
| GB | 238662 | 8/1925 |
| GB | 418217 | 10/1934 |
| GB | 954663 | 4/1964 |
| WO | WO 01/37775 | 5/2001 |

OTHER PUBLICATIONS

JP 08257073A Patent Abstracts of Japan.

* cited by examiner

*Primary Examiner*—Tuan N. Nguyen
(74) *Attorney, Agent, or Firm*—R W Becker & Associates; R W Becker

(57) ABSTRACT

A toilet device, in particular for bedridden persons, includes a lower shell (20) whose top side has a support surface (45; 80, 82) surrounding an opening (30) to receive the stool and urine of a person on the lower shell, in such a way that there is a first sealing line portion between the person and lower shell, which first sealing line portion extends from the inside of one buttock over the coccyx or lower back region to the inside of the other buttock. An upper shell (22) can be mounted to the lower shell and is so formed that in a transitional region between the lower shell and the upper shell (22) connected thereto there are second and third sealing line portions, adjoining the first sealing line portion, in the region of the uppermost insides of the thighs or the lowermost trunk region, which are adjoined by a fourth sealing line portion which extends from one side of the lowermost trunk region over the pubic region or lower abdomen region to the other side of the lowermost trunk region.

10 Claims, 8 Drawing Sheets

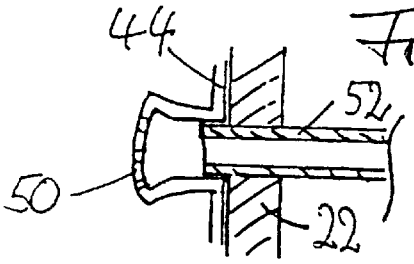
FIG 7
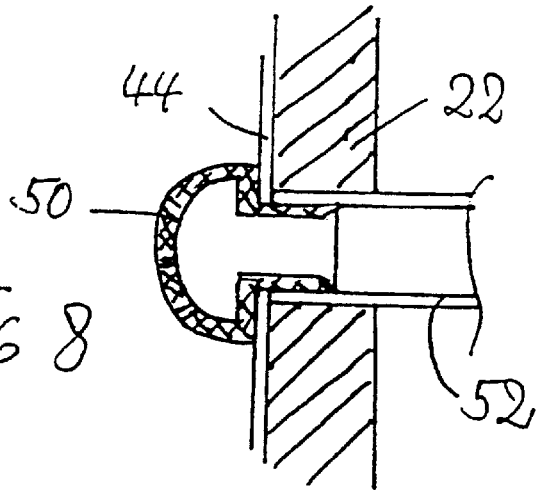
FIG 8
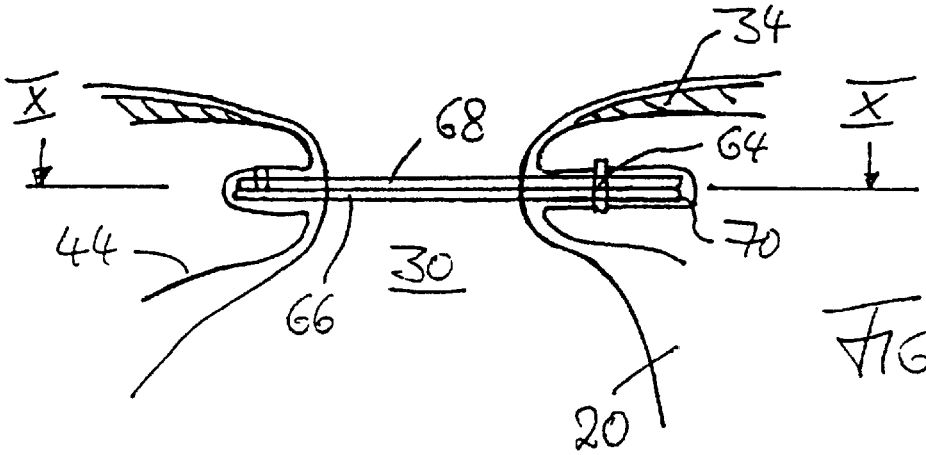
FIG 9
FIG 10
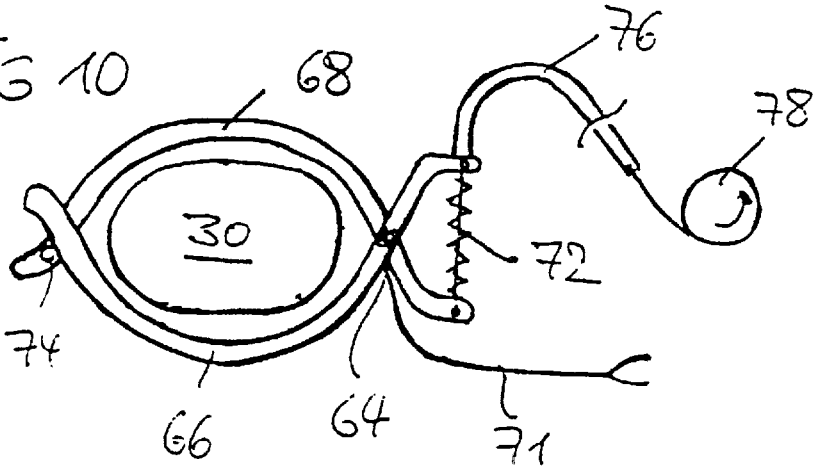

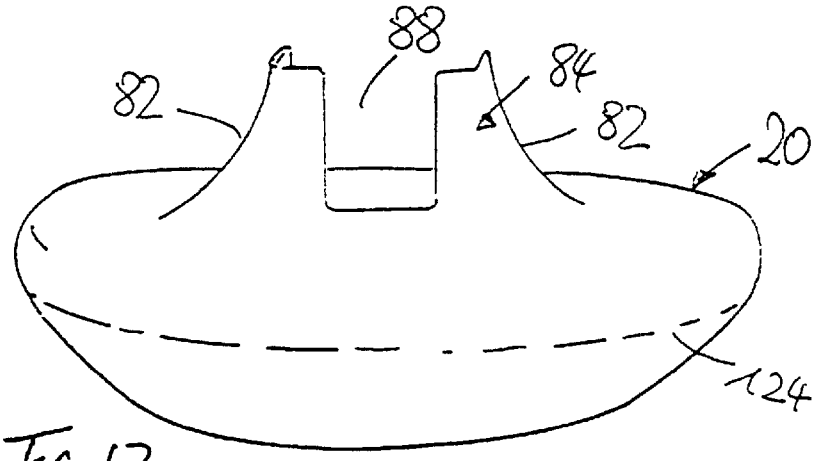
FIG 13
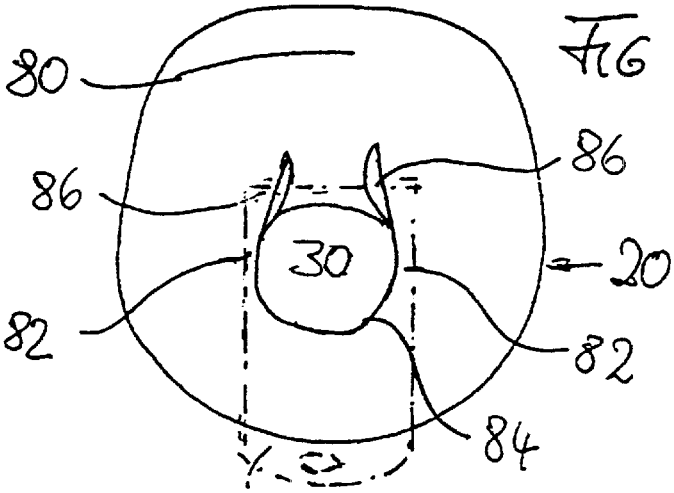
FIG 14
FIG 15
FIG 16
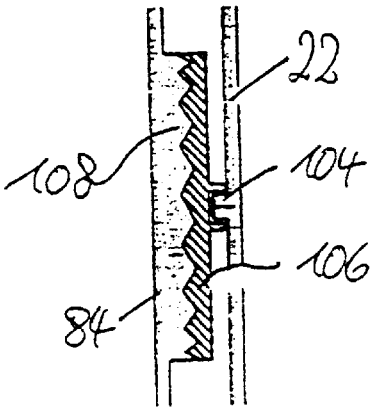
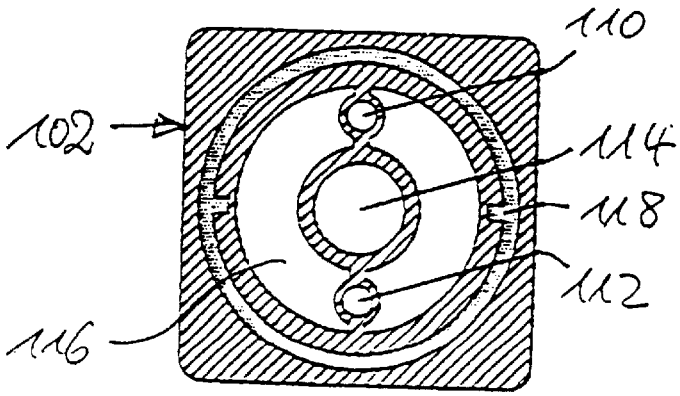

130
132
134
129
128
126
20

TOILET DEVICE, ESPECIALLY FOR BEDRIDDEN PERSONS

BACKGROUND OF THE INVENTION

The invention concerns a toilet device, in particular for bedridden persons, as set forth in the classifying portion of claim 1.

Urination and bowel movements represent major problems not just for bedridden persons but also for the carer staff for reasons of the intimacy of the relationship, hygiene and the work involved. There has therefore been no lack of attempts to provide devices which simplify urination and bowel movements on the part of bedridden persons and resolve the above-indicated problems.

A toilet device of the general kind set forth is known from DE 296 12 166 U1. A toilet device as described in that publication has a lower shell which is adapted to the human anatomy with openings for the waist and the thighs and on its underside has a recess of a volume sufficient to accommodate the excretions. The lower shell is completely open upwardly and extends around a person lying thereon in a line which extends from the waist at both sides of the buttocks under the lower legs and between the lower legs upwardly where the lower shell has a projection projecting upwardly between the thighs. There is no contact with the person in the upper region of the projection. For the purposes of hermetically sealing off the interior of the lower shell, the arrangement has an upper shell which is fitted onto the lower shell in such a way that the thighs of the person and the trunk in the region of the waist extend through the corresponding three, out of the container formed by the upper shell and the lower shell. Provided on the projection on the lower shell are connections for a washing water conduit, a warm air conduit and a feces suction removal conduit so that the anal and genital region of the person can be cleaned and dried, the content of the lower shell can be sucked away and the lower shell can be cleaned.

A particularity of the described toilet device is that satisfactory sealing of the interior thereof, which receives the feces, is only possible with difficulty in relation to different people, as the periphery of the body in the region of the waist and the periphery of the thighs is very different from one person to another. That results in unpleasant odors in the ambient atmosphere. In addition the toilet device is uncomfortable as the person is supported only in the region of the hips and at the thighs.

The Patent Abstracts of Japan in respect of Japanese patent application No 7104551 (publication No 08257073A) discloses a device in which a kind of diaper is fitted to a lying person, the diaper being provided with a connection for sucking away the excretions and a connection for feeding cleaning water and warm air. The operation of fitting the diaper represents a complicated and expensive procedure.

EP 0 494 488 A1 discloses a toilet having a pan or tub, on the edge of which can be arranged a replaceable seat component on which a person sits or lies, depending on the shape of the tub. Excrements can be sucked away from the tub. The tub is further provided with nozzles for washing water and for the feed of drying warm air.

EP 0 689 790 A1 discloses a portable seat toilet which is provided with replaceable seat covers and a bag for receiving the excrement.

The object of the invention is to provide a toilet device, in particular for bedridden persons, which particularly satisfies the demands which occur in a practical context.

SUMMARY OF THE INVENTION

That object is attained by a toilet device in accordance with the main claim.

In accordance with the invention the lower shell is so designed that it comfortably supports in sealing relationship a person thereon, who can be lying or sitting. In that respect the sealing effect or the contact of the lower shell against the person takes place along the insides of the buttocks so that the sealing effect extends directly to the crotch region of the trunk at the insides or between the thighs from where it is closed by means of the upper shell directly over the pubic region. The body regions which are intended to come into contact between a person and the lower and upper shell respectively are of similar dimensions in regard to corpulent and slender persons, irrespective of their sex, so that this device affords comfortable support and satisfactorily sealing contact. The lower shell and in particular the upper shell can be comparatively small. The entire range of demand can be covered with two or three sizes (children, adolescents, adults).

The features of claim 2 provide for good adaptability of the toilet device to individual persons.

Claim 3 characterizes an advantage embodiment of the lower shell with which satisfactory positioning of a person can be checked in a simple manner.

The features of claim 4 provide for a certain spreading of the buttocks, whereby cleaning after a bowel movement is made easier.

Claims 5 and 6 characterize advantageous embodiments of the toilet device for cleaning and drying of the person using it, wherein the air evacuation conduit affords the advantage that air is continuously sucked somewhat out of the toilet device. That ensures that no odors occur in the ambient atmosphere.

The features of claim 7 afford the advantage that the feces together with the washing water can be disposed of in an extremely simple fashion, in which respect the foil can additionally be such that it covers all regions with which the person comes into contact, so that practically no cleaning of the toilet device is required between two uses thereof.

Claim 8 characterizes a configuration of the foil which is particularly handling-friendly.

The features of claim 9 afford a simple possible way of ambient air being sucked into the space between the lower shell and the upper shell, even when the space is completely sealingly closed off the person. In addition, with a suitable design configuration in respect of the air feed valve, the reduced pressure in the interior between the lower shell and the upper shell can be adjusted in order for example to ensure that the foil or the receiving bag does not collapse in or that an excessively reduced pressure which is unpleasant to the person does not occur due to the air suction removal effect.

In accordance with claim 10 there is provided a supply unit in which all devices for the toilet device are assembled.

BRIEF DESCRIPTION OF THE DRAWINGS

The invention is described in greater detail hereinafter by way of example with reference to diagrammatic drawings in which:

FIG. 7 shows a detail cross-section of a nozzle on the foil, FIG. 8 shows a detail cross-section of a push-on nozzle, FIG. 9 shows a cross-section through an opening in a lower shell with closing device arranged therein, FIG. 10 shows a view of the arrangement of FIG. 9, in section in plane X—X, FIG. 13 shows a rear view of the lower shell, FIG. 14 shows a plan view of the lower shell, FIG. 15 shows a diagrammatic view of a fixing of the upper shell to the lower shell, FIG. 16 shows a diagrammatic view of a multiple connection for supply conduits.

DESCRIPTION OF PREFERRED EMBODIMENTS

Figure 1:
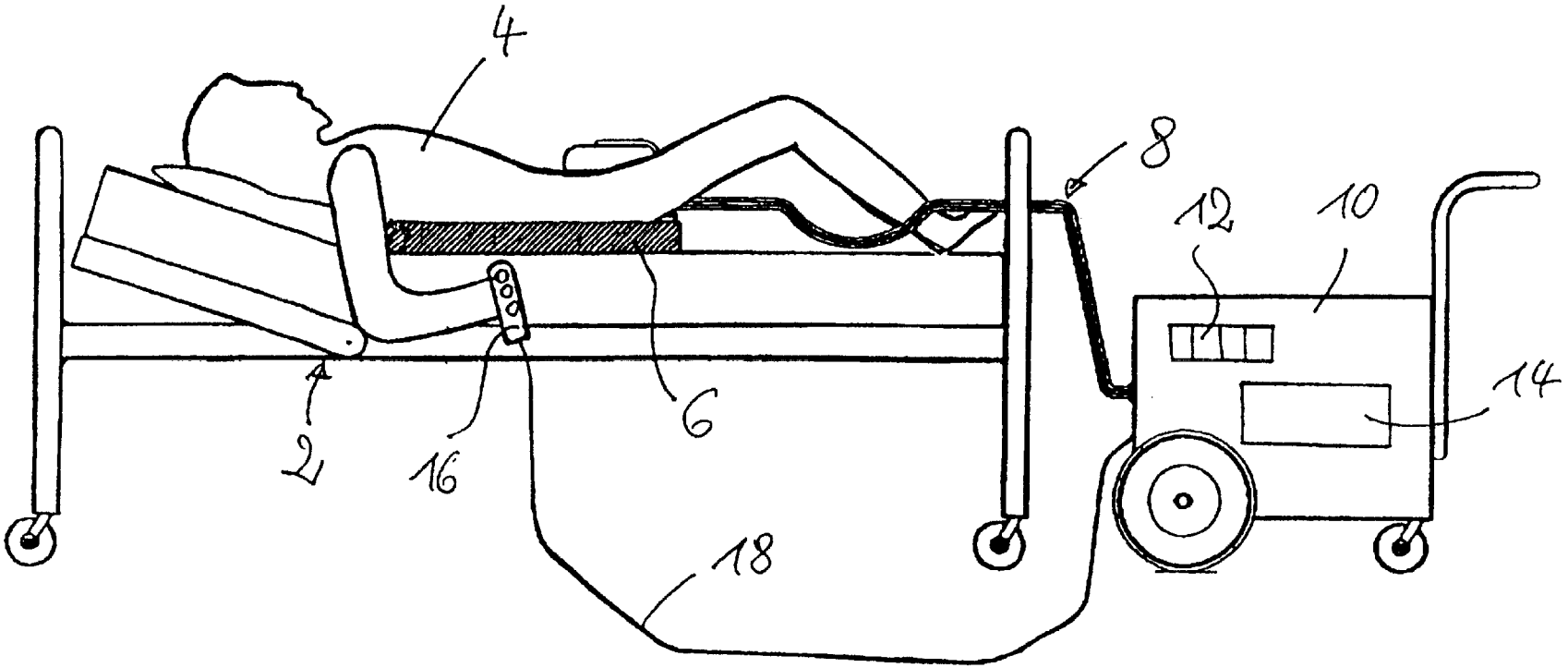
FIG. 1 shows a side view of a bed with a bedridden person and the toilet device according to the invention.

Referring to FIG. 1, a person 4 is lying in a bed which is generally identified by reference 2 and which is for example movable. Inserted between the person 4 and the mattress or sheet of the bed is a portable toilet 6 which extends from the back to the thighs and which projects upwardly between the thighs and covers over the genital region of the person. Hoses or conduits 8 lead from the toilet 6 to a movable supply unit 10 which has operating elements 12 and displays 14. A remote operating unit 16 which can be gripped by the person 4 is connected by way of a cable 18 to the supply unit 10 or communicates cordlessly with the supply unit in per se known manner.

Figure 2:
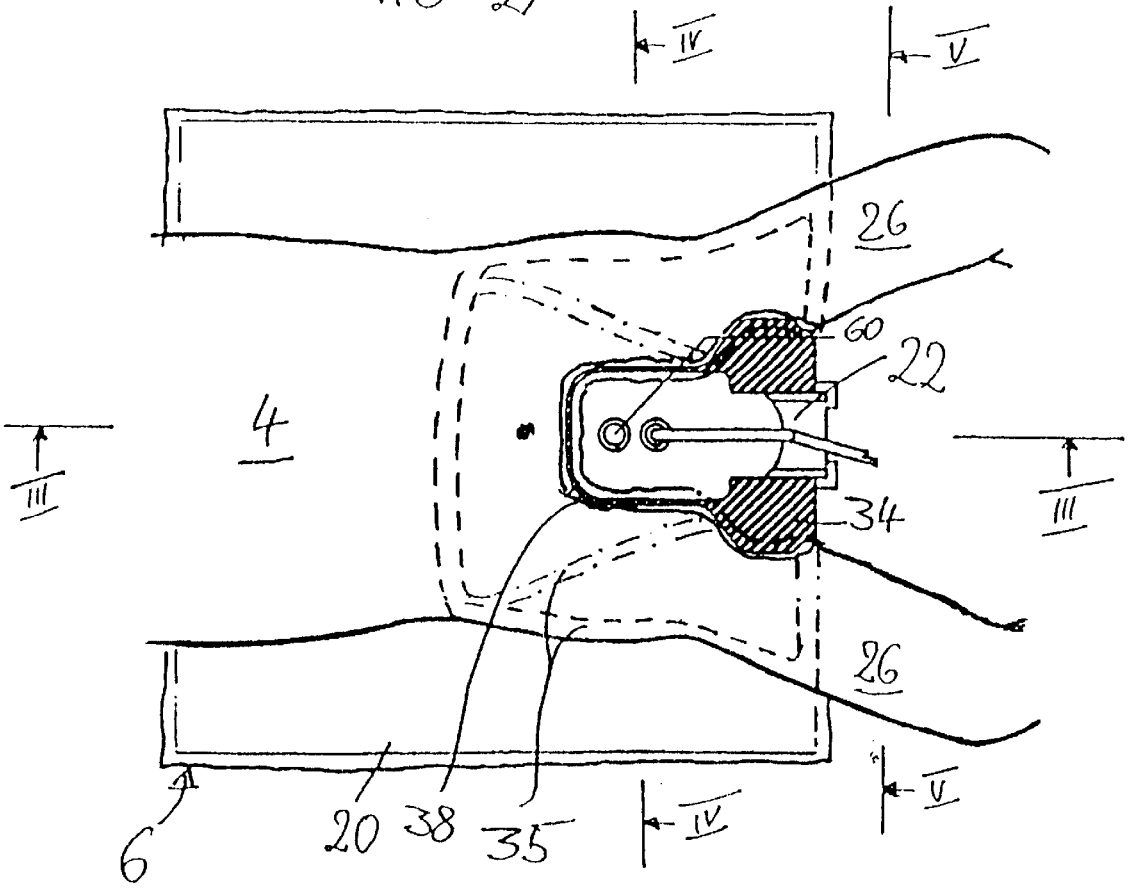
FIG. 2 shows a plan view of a part of FIG. 1.
Figure 3:
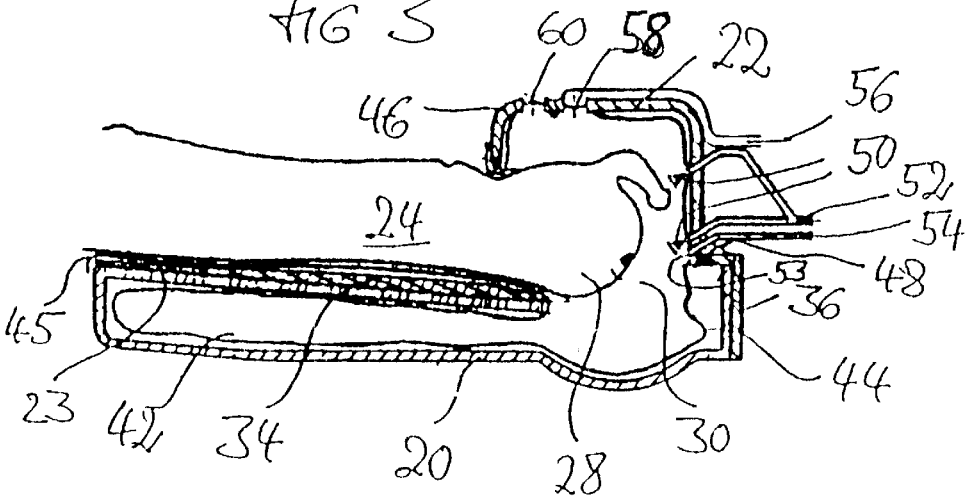
FIG. 3 shows a section in plane III—III in FIG. 2.

FIG. 2 shows a plan view of the toilet 6 with a person 4 thereon as shown in FIG. 1. FIG. 3 shows a longitudinal section through the arrangement of FIG. 2, in section in the plane III—III.

Figure 4:
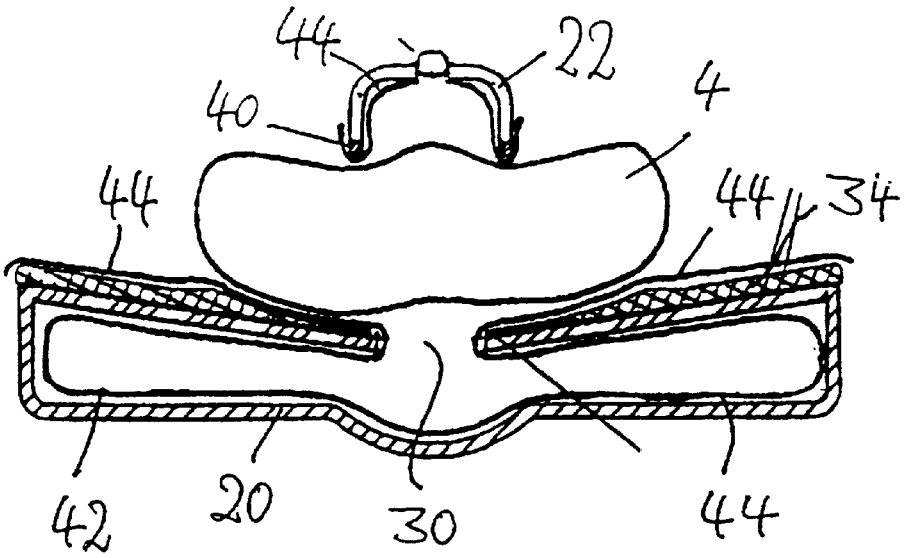
FIG. 4 shows a section in plane IV—IV in FIG. 2.
Figure 5:
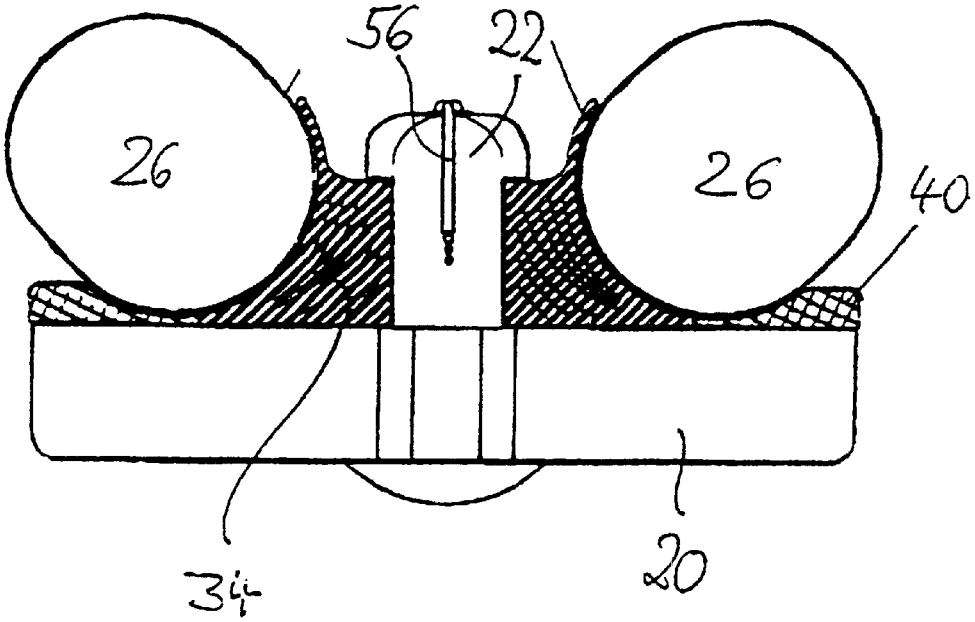
FIG. 5 shows a section in plane V—V in FIG. 2.

FIGS. 4 and 5 show cross-sections through the arrangement in FIG. 2, in section in the planes IV—IV and V—V.

FIGS. 2 through 5 are described jointly hereinafter.

The toilet includes a lower shell 20 and an upper shell 22. The lower shell 20 has a large-area support 23 for at least the lower region of the back 24 and the lower region of the body including at least the inner upper end regions of the thighs 26. In the region of the buttocks 28 the lower shell which is almost entirely closed has an opening 30 through which the interior 32 of the lower shell is accessible. The top side of the lower shell 20 is provided with cushionings 34 which adapt to the anatomy of the body and which are extended upwardly in the region between the thighs so that, when a person is lying on the lower shell, there is a peripherally extending sealing line 35 (shown in broken line in FIG. 2) or a peripherally extending sealing region which extends around the opening 30. Advantageously the support surface of the lower shell around the opening 30 is raised in such a way that the sealing line 35 extends along the insides of the buttocks to the insides of the thighs or the crotch region of the trunk between the thighs, as shown by the dash-dotted lines and as will be described in greater detail hereinafter with reference to FIGS. 11 through 14.

Fixed on the lower shell 20 is an upper shell 22 which is open towards the lower shell for example by virtue of it being fixed with a lower portion 36 (FIG. 3) to the end of the upper shell by clipping attachment thereto. The upper shell 22 extends between the thighs 26 and, leaving a hollow space towards the body of the person, is of such a configuration that its cushioned edge region forms a sealing line 38 or a sealing region which adjoins the sealing line 35 formed by the lower shell and extends along the upper end regions of the insides of the thighs from the crotch region, surrounding the genital region, over the lower abdomen region or pubic region.

Inserted into the lower shell 20 through the opening 30 is a sheet or foil 44 which forms a receiving bag 42 within the lower shell and which with a flat region 45 covers over the top side of the lower shell 20 in the entire support region for the person 4 and has a projection 46 which prolongs the flat region 45 and which covers over the entire inside of the upper shell 22. By virtue of the described arrangement, the foil 44, over the sealing regions 35 and 38 and the coverage thereof of the separation between the upper shell 22 and the lower shell 20, forms an internal space which is outwardly substantially sealingly closed off and which is delimited only by the inside of the foil and regions of the surface of the person 4. It will be appreciated that the foil can also be of a multi-part nature, for example the projection can be a specific piece of foil.

Figure 6:
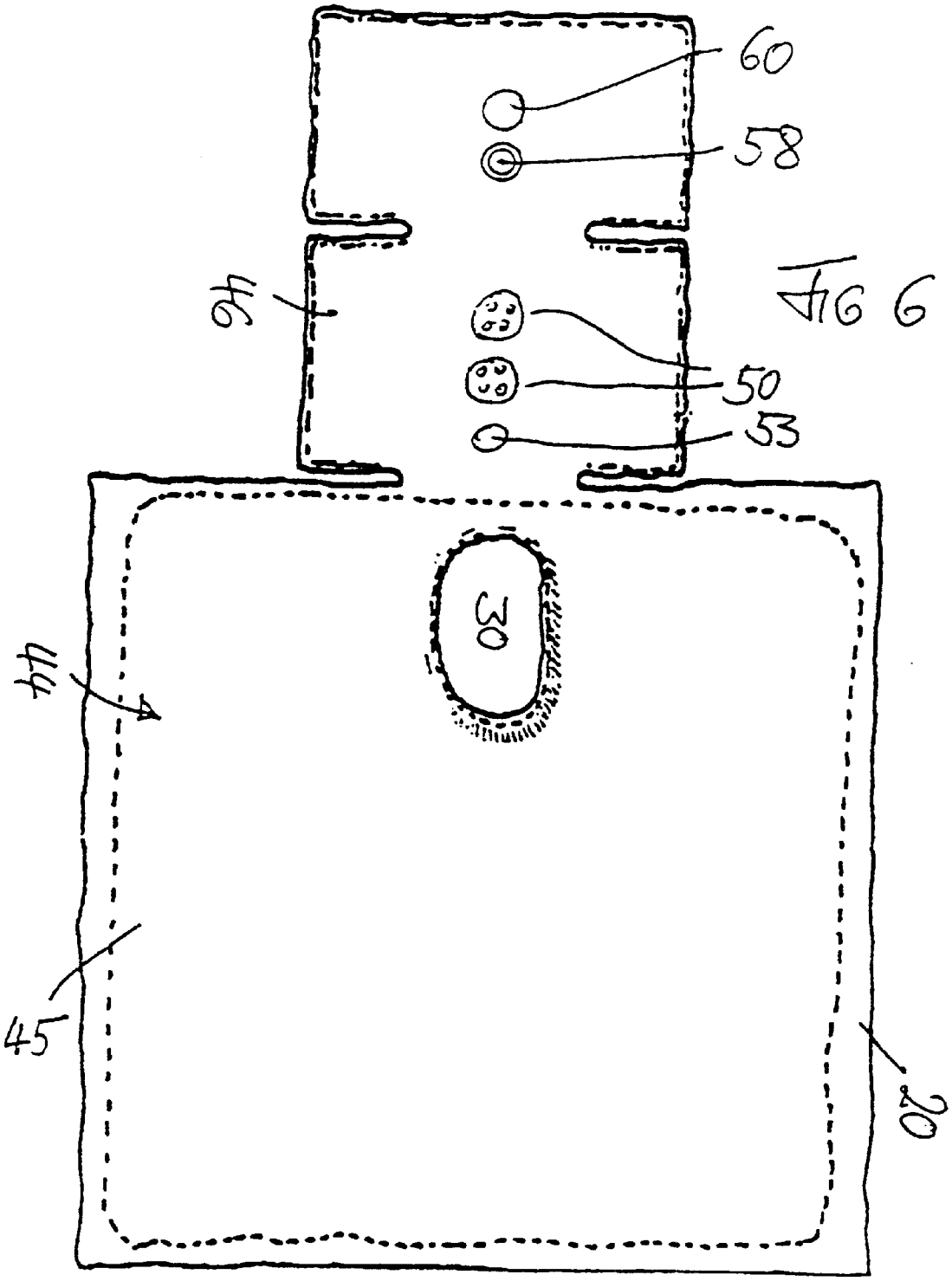
FIG. 6 shows a view to illustrate the shape of the foil with integrated receiving bag.
Figure 11:
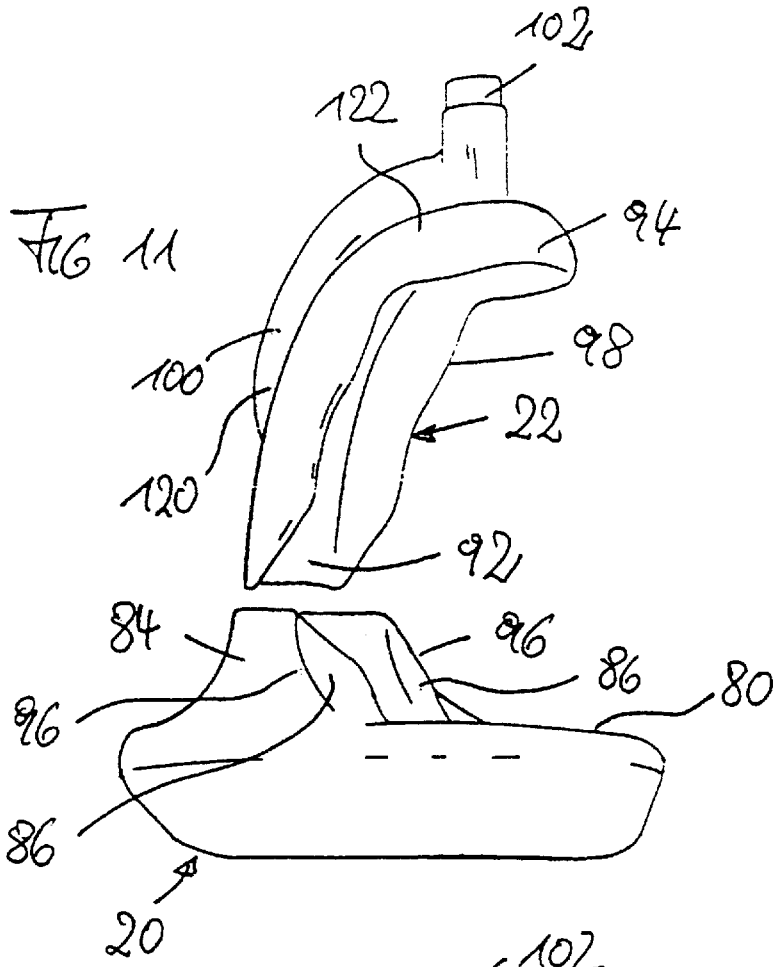
FIG. 11 shows a perspective view of an upper and lower shell of a modified embodiment of the toilet device.

FIG. 6 shows the foil 44 lying on the lower shell 20, with the opening 30, the flat region 45 and the projection 46 for bearing against the inside of the upper shell 22. The optional incisions in the lateral region of the projection 46 serve for better adaptability thereof to curvatures between the lower shell and the upper shell and in the region of the upper shell.

As can be seen in particular from FIG. 3 washing nozzles 50 project into the interior of the upper shell 22 which is advantageously fixed to the portion 36 thereof by way of a hinge 48. The washing nozzles 50 are connected to a fluid conduit 52. The opening 53 of a warm air conduit 54 also projects into the interior which is delimited by the foil 44.

In addition, the device has a reduced pressure conduit 56 which is connected to an air evacuation opening 58 of the foil 44. In addition the foil is provided with an air feed valve 60 which for example is in the form of a simple non-return valve flap, wherein the foil can be reinforced in the region of the non-return valve flap to produce an elastic closing force.

FIG. 7 shows an embodiment by way of example of a washing nozzle 50 and the connection thereof to the conduit 52. In this case the foil 44 is formed in one piece with the washing nozzle 50 insofar as in the manufacture thereof it is directly suitably shaped and apertured or a nozzle attachment is welded to the foil. The conduit 52 extends through the upper shell 22 and protrudes slightly so that the inner edge of the nozzle 50 can be fixed to the projection of the conduit 52.

FIG. 8 shows a modified embodiment in which the washing nozzle 50 is in the form of a separate component which, when the foil 44 is disposed in the upper shell 22, can be pushed therethrough, piercing the foil, and can be fixed in the conduit 52. The openings 53 and 58 can be formed similarly to the nozzle 50 and can serve for fixing the foil 44. It will be appreciated that the nozzles, opening inserts and so forth can advantageously be designed in the form of disposable articles.

The conduits 52, 54 and 56 and possibly further conduits and cables are combined together to constitute a conduit run 8 (FIG. 1) and connected to the supply unit 10 which includes one or more temperature-controllable cleaning and washing fluid tanks, a hot air blower and a reduced-pressure pump for connection to the reduced-pressure conduit 56. Also provided in the supply unit is a filter device for filtering air which is sucked out of the toilet 6 so that no odorous effects occur in a room.

FIGS. 9 and 10 are perpendicular and horizontal sections showing a closing device 62 for the receiving bag 42 which is passed through the opening 30.

The closing device 62 includes two arms 66 and 68 which are mounted scissor-like at a pin 64 and which are accommodated in an annular recess 70 in the lower shell 20 and which extend around the opening 30. The arms 66 and 68 are elastically biased in the opening direction by means of a spring 72, with the opening movement being limited by an abutment 74 provided on one of the arms. By means of a Bowden cable 76 actuated by an electric motor 78, the arms 66 and 68 are pivotable in such a way that they close the opening, entraining the foil 44 which is passed through the opening 30. Provided at the inward sides of the arms 66 and 68 is a heating wire 71, wherein the foil or the receiving bag 42 is closable when the heating wire is supplied with power.

The mode of operation of the described device is as follows:

A lower shell is provided with the foil 44 by the receiving bag 42 being introduced through the opening 30 and the remaining foil, leaving the opening 30, being laid onto the top side of the upper shell 22, in which case fixing devices in the form of adhesive points, hook-and-loop fastener strips and the like can possibly be provided. The portion 36 pivotably connected to the upper shell 22 is fitted to the end of the lower shell. Washing nozzles 50 and openings 53 and 58, provided in the projection 46 of the foil 44, are fixed to the associated conduits and the air feed valve 60 is fixed to the corresponding aperture in the upper shell. The projection 46 is thus fixed to the upper shell, in which case additional adhesive points, hook-and-loop fastener strips and the like can be provided.

The lower shell is pushed under the person 4 until the thighs of the person come into firm contact against the corresponding cushion or edge regions of the lower shell or the buttocks region of the person is above the opening 30. The upper shell 22 is then pivoted upwardly so that the edge regions thereof come to bear against the top side of the lower shell 22, the inner thigh regions and the lower abdomen region and enclose the genitalia. The pivot 48 can be provided with a latching device which holds the upper shell 20 fast so that the lower shell rests securely on the person and the internal space defined by the foil 44 and the person 4 is sealed off as well as possible relative to the exterior.

The person 4 by way of the remote operating unit 16, sets the reduced-pressure pump contained in the supply unit 10 in operation so that the internal space defined by the foil is put under a slightly reduced pressure, in which case fresh air is sucked in through the air feed valve 60, the air being filtered or neutralized in respect of odor or slightly perfumed in the supply unit 10 so that no unpleasant odors can occur.

The person 4 can now perform a bowel movement and urinate. The person then uses the remote operating unit to implement a cleaning procedure in which cleaning fluid is supplied by way of the suitably arranged washing nozzles 50, to reliably clean the genital and buttocks region of the person. A rinsing operation can then follow, in which rinsing is effected with clear water which possibly contains skin-care additives. The drying step is then initiated by the warm air blower of the supply unit 10 being activated. In that case the reduced-pressure pump in the supply unit advantageously switches to a higher delivery. The temperature controls and flow speed of the fluids and the air can be individually adjusted or pre-programmed. The warm air blower is switched off after the drying operation. The reduced pressure which is then greater reduces the receiving bag to a slightly larger volume than the excrement and liquid contained therein. In that condition, the electric motor is actuated to close the receiving bag 42 and then the heating wire 71 is supplied with power to weld the foil 44. It will be appreciated that the reduced pressure when actuating the closing device can be intensified by increasing the power supplied to the reduced-pressure pump. After the receiving bag 42 is closed the reduced-pressure pump is switched off and the upper shell pivoted open. The upper shell is then pulled away together with the lower shell from under the person. The projection 46 of the foil can then be released from the upper shell, in which case all nozzles, opening inserts and so forth remain on the foil and the entire foil is removed with the closed receiving bag for disposal thereof. In that case, all handling can be effected from the outside of the foil. It will be appreciated that the foil advantageously comprises biodegradable material so that total disposal thereof without any problem is possible.

The described device can be modified in many different ways. The nozzles and openings can be arranged at different locations from those shown and can be provided at least in part also in the lower shell. In addition the shells can be arranged in such a way that a person does not necessarily have to be lying, but can also use the toilet device in a sitting position. The foil 44 can be enclosed in the region of the opening 30 by a pull-tight band which forms the closing device. Stowage space for a plurality of used foils 44 or receiving bags can be provided in the supply unit. The cushioning can be at least in part inflatable by way of a suitable compressed air connection in order to provide for optimum adaptation to the person. The air feed valve 60 can be in the form of an electrically operable valve. The upper shell can be mounted to the lower shell only when a person is on the lower shell, and so forth.

The described embodiment of the toilet device represents a maximum expansion stage in which parts of the re-used structural groups of the toilet device, which come into contact with the person, are covered with the foil which is used once and which is such that it receives all excrement and liquids and is disposed of after use of the toilet. From the point of view of the carer staff this signifies a major simplification in their work.

In a modified embodiment the toilet device can be used without the foil 44. The upper shell and the lower shell then admittedly have to be cleaned between two uses; that device however still retains the great advantage of the high level of comfort and convenience for the user and the good sealing action which protects the ambient atmosphere from unwanted odors.

It will be appreciated that, in the case in which no foil is used, it is possible to connect to the lower shell a feces suction removal conduit (not shown), by way of which the content of the lower shell can be sucked into a suitable tank in the supply unit.

A further embodiment of the toilet device which in the illustrated example is employed without a foil will be described hereinafter with reference to FIGS. 11 through 16.

The lower shell of this embodiment is shortened in comparison with the embodiment shown in FIG. 3 and, in its front region, has a support surface 80 for the coccyx region of a person. Laterally of the opening 30 the support surface 80 is extended in support regions 82 which are formed by inclined side surfaces of a projection 84 which is generally U-shaped in plan and which is open towards the support surface 80 and which in other respects extends around the opening 30. The front ends of the support regions 82 are specifically designed with inclined surfaces 86, the function of which will be further described hereinafter. At the rear side the projection 84 has a recess 88. To close its internal space the lower shell 20 preferably has a slider 90 which is shown in dash-dotted line in FIG. 14.

The upper shell 22 is generally U-shaped in cross-section and is in the form of an arcuate portion involving an angle of about 90°. The U is open at the lower end 92 of the upper shell and closed at the upper end 94. The lower end 92 and the projection 84 are matched to each other in such a way that the upper shell 22 can be inserted in the projection 84 of the lower shell 20, bearing against the wall regions thereof, in which case the front edges 96 of the projection 84 go flush into the edge 98 of the upper shell 22. The back of the upper shell 94 has a conduit attachment 100 which has a multiple connection 102.

FIG. 15 shows a diagrammatic view illustrating a possible way in which the upper shell 22 can be slidably and tiltably fixed to the lower shell 20. For that purpose, in the region which can be inserted into the projection 84 of the lower shell, the upper shell is provided with two diametrally oppositely disposed mounting trunnions or journals 104 on which are mounted fixing portions 106 which are displaceable relative to fixing protrusions 108 provided on the projection 84. The surfaces which are in mutual contact of the fixing portions and the fixing protrusions are serrated so that displacement involves a latching action. By means of the depicted fixing arrangement, the upper shell 22 is slidable relative to the lower shell 20 and tiltable to a certain extent.

FIG. 16 shows a plan view of the multiple connection 102. The multiple connection includes two warm water feed conduits 110, 112, a warm air feed conduit 114 and an air evacuation conduit 116. By means of a bayonet 118, it is possible to connect to the multiple connection 102 a corresponding counterpart portion of a multiple connection hose leading to the supply unit 10 (FIG. 1).

The warm water feed conduit 110 leads for example to washing nozzles which are disposed in the region 120 of the upper shell 22 in order to direct washing water onto the anal region of a person using the toilet. The warm water feed conduit 112 is connected to nozzles which are arranged in the region 122 of the upper shell 22 for cleaning the genital region of a person. The warm air feed conduit 114 is connected to a plurality of outlets (not shown) through which warm air is introduced into the upper shell in order to flow along the genitalia and the anus of the person. The air evacuation conduit 112 leads directly into the internal space of the upper shell 22.

The mode of operation of the described toilet device is as follows:

The lower shell 20 is passed to a person who is for example in a bed. The person who is lying on the back pushes the lower shell between the legs and under the buttocks, in which case the lower shell is pressed into the soft bed mattress and the coccyx comes to lie on the support surface 80. When the lower shell is further pushed into position, the inclined surfaces 86 bear against the inside of the buttocks and slightly spread them so that the anus is exposed. Satisfactory positioning in this fashion can be assessed by an operator for example through the recess 88. The upper shell 22 is now fitted into the lower shell 20 and urged downwardly so that the edge 98 comes to bear against the pubic region, enclosing the genitalia. Overall there is between the person and the lower shell a seal which extends from the coccyx region along the insides of the buttocks. A further sealing region is afforded by the edge 98 of the upper shell which is accommodated slidably and tiltably in the lower shell and which is pressed against the pubic region; the further sealing region extends over the pubic region on both sides thereof in a direction towards the sealing region formed by the lower shell. The transitional region between the two sealing regions, which extends directly from the inside of the buttocks along the uppermost inside of the thighs or the lowermost trunk region (crotch region) is formed by the lower shell and/or the upper shell, depending on the respective height of the projection 84.

From the point of view of the person, this provides a comfortable lying or sitting position in which the internal space of the upper and lower shells is soundly sealed off by the person. The multiple connection 102 is now connected to a corresponding multiple connection of a connecting hose between the supply unit and the toilet can be used, as described hereinbefore. During use, an air suction removal effect takes place continuously, which can be promoted by an air feed valve (not shown), through which external air flows into the internal space in the toilet device. That ensures that the ambient atmosphere is not exposed to any odor effects. After use of the toilet is concluded and the person has been cleaned the slider 90 is closed so that no odor effects occur when the lower shell is pulled out from under the person.

For the purposes of emptying and cleaning the lower shell 20 it can be advantageous for the lower shell itself to be of a two-part structure, as is indicated by the broken line 124 in FIG. 13.

Figure 12:
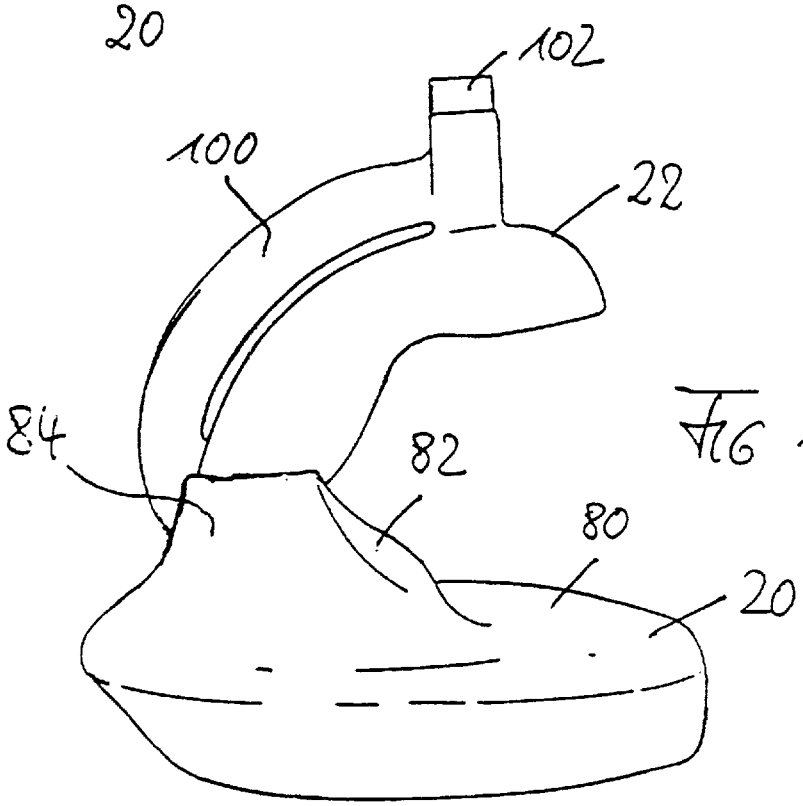
FIG. 12 shows a side view of the toilet device of FIG. 11 with the upper shell fitted into the lower shell.

The toilet device, as shown in FIGS. 11 through 16, can also be modified in many different ways. For example it can be used together with a foil, similarly to the embodiment first described above. The lower shell can be provided with a feces suction removal conduit. In a minimal embodiment, all conduit connections and supply openings can be omitted so that the upper and lower shells are used as a comfortable and luxury toilet which only involves minimal odor effects. The upper and lower shells can be designed as disposable products insofar as they are made from suitably inexpensive, advantageously biodegradable plastic material or other environmentally friendly materials which for example contain a high proportion of natural fibers. In a modified embodiment the upper shell can be so designed that it is not fixed by attachment directly to the projection 44 but has a fixing loop which can be fixed from the outside to the lower shell 20 for example as shown in FIG. 12 in the left-hand region thereof.

Figure 17:
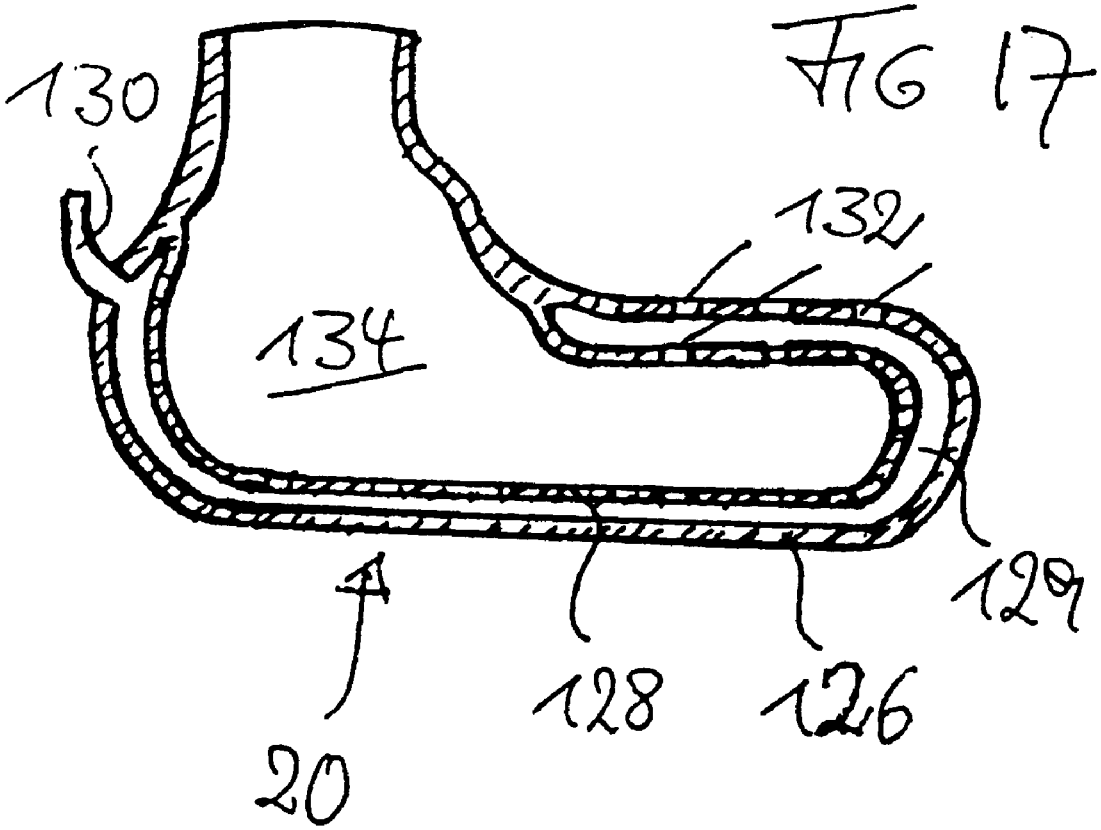
FIG. 17 shows a longitudinal section through a modified embodiment of a lower shell.

FIG. 17 shows a longitudinal section through a modified embodiment of a lower shell. The lower shell of this embodiment, generally indicated by reference 20, is of a double-shell nature with an outer shell 126 and an inner shell 128. The two shells are formed integrally with each other and form between them a hollow space 129 into which leads a connection 130 which can be connected to a suction removal or reduced-pressure conduit. The walls of the inner shell and the outer shell are provided with holes 132.

The embodiment of the lower shell shown in FIG. 17 affords the advantage that, when the connection 130 is subjected to the action of reduced pressure, air is sucked through the holes 132 into the hollow space 129 and from there sucked away through the connection 130. If a foil as described with reference to the embodiment described hereinbefore is introduced into the internal space 134, then the foil is subjected to a suction effect by the holes in the inner shell, so that it bears securely against the inside of the inner shell. The holes in the outer shell 126 serve to apply a suction effect to the foil which covers parts of the outward side of the outer shell so that the foil is securely held there. It will be appreciated that only those regions of the outer shell against which a foil comes to bear have to be provided with holes. It may be advantageous for the foil to be caused to press or bear against the inside of the inner space by injecting air and then, if necessary, subjecting it to a suction attraction force by way of the holes.

It will be appreciated that features of the described embodiments can be combined together in very different ways.

The specification incorporates by reference the disclosure of German priority document 199 56 722.0 filed Nov. 25, 1999 and International priority document PCT/EP00/09560 filed Sep. 29, 2000.

The present invention is, of course, in no way restricted to the specific disclosure of the specification and drawings, but also encompasses any modifications within the scope of the appended claims.

List of References

2 bed
4 person
6 toilet
8 conduits
10 supply unit
12 operating elements
14 displays
16 remote operating unit
18 cable
20 lower shell
22 upper shell
23 support
24 back
26 thigh
28 buttock
30 opening
32 internal space
34 cushioning
35 sealing line
36 portion
38 sealing line
42 receiving bag
44 foil
45 flat region
46 projection
48 pivot
50 washing nozzles
52 fluid conduit
53 warm air opening
54 warm air conduit
56 reduced-pressure conduit
60 air feed valve
62 closing device
64 trunnion
66 arm
70 recess
71 heating wire
72 spring
74 abutment
78 electric motor
80 support surface
82 support regions
84 projection
86 inclined surface
88 recess
90 slider
92 lower end
94 upper end
96 front edges
98 edge
100 conduit projection
102 multiple connection
104 mounting trunnion
106 fixing portion
108 fixing protrusion
110 fluid feed conduit
112 fluid feed conduit
114 warm air feed conduit
116 air evacuation conduit
118 bayonet
120 region
122 region
124 line
126 outer shell
128 inner shell
129 hollow space
130 connection
132 hole

What is claimed is:

1. A toilet device, in particular for bedridden persons, comprising:

a lower shell having an edge region for bearing against a lower region of the back of a person resting on the lower shell; and an upper shell which projects from the lower shell between the thighs of a person resting on the lower shell, wherein a top side of the lower shell is formed with a support surface which surrounds an opening, for receiving stool or urine of a person resting on the lower shell, in such a way that there is a first sealing line portion for sealing between the person and the lower shell, said first sealing line portion extending from the inside of one buttock over the coccyx or lower back region to the inside of the other buttock, and a transitional region between the lower shell and the upper shell is such that adjoining a respective end of said first sealing line portion are a second and a third sealing line portion respectively, which each respectively seal off between a region of an uppermost inward side of a thigh and a side of the lowermost trunk region, and the transitional region, and wherein the upper shell is in the form of a component that is separate from the lower shell and is shaped and can be connected to the lower shell in such a way that in a fourth sealing line portion, which adjoins the second and third sealing line portions and which extends from one side of the lowermost trunk region over the pubic or lower abdomen region to the other side of the lowermost trunk region, it can be brought into contact with a person using the toilet device so that an internal space formed between the lower shell and the upper shell and the person is substantially sealed off relative to the exterior.

2. A toilet device as set forth in claim 1, wherein the upper shell is mounted to the lower shell so as to be at least one of pivotable and slidable in a vertical direction.

3. A toilet device as set forth in claim 1, wherein the lower shell has a projection which is generally U-shaped in plan for insertion of the upper shell, which is generally U-shaped in cross-section, and a wall of the projection which forms a leg of the U and which is remote from the opening is provided with a recess.

4. A toilet device as set forth in claim 1, wherein a region of the lower shell which is intended for support for the insides of the buttocks is inclined in such a way that it moves the buttocks away from each other when they are supported thereon.

5. A toilet device as set forth in claim 1, wherein provided on the upper shell are at least one washing opening connectable by way of a fluid conduit to a fluid source for washing the genital and anal region of the person, at least one warm air opening connectable by way of a warm air conduit to a warm air source for drying the cleaned region of the body, and at least one air evacuation opening connectable to an air evacuation conduit.

6. A toilet device as set forth in claim 5, wherein the upper shell has a multiple connection for connecting a fluid conduit, warm air conduit and air evacuation conduit, and is formed with at least one integrated conduit which leads from the multiple connection to an opening leading into the interior of the upper shell.

7. A toilet device as set forth in claim 5, wherein the lower shell is covered with a foil which forms a receiving bag for excrement and cleaning fluid and which includes a projection extending through between the thighs and which is of such a configuration that it completely covers over the edge region, which comes into contact with the person, of the lower shell and an edge region of the upper shell, forming an internal space which is at least substantially sealed relative to the exterior, and is provided with openings corresponding to the openings for fluid, warm air or discharge air of the upper shell.

8. A toilet device as set forth in claim 7, wherein nozzles connected to the openings in the foil are of such a configuration that they remain on the foil upon removal of the foil from the lower shell and the upper shell.

9. A toilet device as set forth in claim 5, wherein an air feed valve is provided.

10. A toilet device as set forth in claim 5, wherein a mobile supply unit with fluid tank, fluid heating means, fluid pump, warm air blower, reduced-pressure pump, filter device and connecting conduits, and having a control device, is provided.

* * * * *